United States Patent [19]

Brisson

[11] Patent Number: 4,538,023

[45] Date of Patent: Aug. 27, 1985

[54] AUDIO SIGNAL CABLE

[76] Inventor: Bruce A. Brisson, 1081 Kachina Ct., Fremont, Calif. 94539

[21] Appl. No.: 567,080

[22] Filed: Dec. 30, 1983

Related U.S. Application Data

[63] Continuation-in-part of Ser. No. 372,550, Apr. 28, 1982.

[51] Int. Cl.[3] ..... H01B 11/12

[52] U.S. Cl. ..... 174/115; 174/113 R; 174/113 A; 174/128 R

[58] Field of Search ..... 174/113 A, 113 R, 115, 174/128 R, 130; 333/1, 236

[56] References Cited

U.S. PATENT DOCUMENTS

| | | | |
|---|---|---|---|
| 1,211,153 | 1/1917 | Hochstadter | 174/115 |
| 1,727,971 | 9/1929 | Ford | 174/113 R |
| 2,978,530 | 4/1961 | Braeckman | 174/128 R |
| 3,261,907 | 7/1966 | Morrison | 174/115 |
| 3,355,544 | 11/1967 | Costley et al. | 174/130 |
| 3,602,632 | 8/1971 | Ollis | 174/113 R |
| 3,815,054 | 6/1974 | McClure et al. | 174/115 X |
| 4,131,757 | 12/1978 | Felkel | 174/128 R |
| 4,158,185 | 6/1979 | Dageforde et al. | 174/128 R X |
| 4,250,351 | 2/1981 | Bridges | 174/106 R |

FOREIGN PATENT DOCUMENTS

| | | | |
|---|---|---|---|
| 572618 | 11/1923 | France | 174/128 R |
| 2049262 | 4/1979 | United Kingdom | 174/115 |

*Primary Examiner*—A. T. Grimley
*Assistant Examiner*—Morris H. Nimmo
*Attorney, Agent, or Firm*—Fliesler, Dubb, Meyer & Lovejoy

[57] ABSTRACT

An audio cable in which a plurality of outer conductors surround one or more inner conductors. The outer conductors provide a path for the relatively high frequency components of the signal and the inner conductors provide a path for the relatively low frequency components of the signal. The length of each outer conductor is greater than the length of the inner conductors and the outer conductors are wound around the inner conductors so that the frequency components of the signal arrive at the end of the end of the cable at the same time.

14 Claims, 3 Drawing Figures

AUDIO SIGNAL CABLE

CROSS REFERENCE TO RELATED APPLICATIONS

This application is a continuation-in-part of application Ser. No. 372,550 filed Apr. 28, 1982.

BACKGROUND OF THE INVENTION

This invention relates to a cable for transmitting audio signals and, more particularly, to a multi-conductor audio cable for transmitting the different frequency components of an audio signal without any relative time delays between the various frequency components.

When audio signals are transmitted through a cable formed by a plurality of conductors the relatively high frequency components of the signal pass through the cable at a faster rate of speed than the relatively low frequency components. Thus the higher frequency components arrive at the end of the cable before the lower frequency components resulting in a signal at the end of the cable that is not a perfect replica of the signal introduced to the cable. This situation is compounded by the fact that the higher frequency components of the signal tend to move towards the outer surface of the cable due to the "skin effect," and the lower frequency components tend to move towards the higher magnetic field in the center of the cable, which further slows down the lower frequency components causing a further delay of the lower frequency components. When a cable of this type is connected between components in a music reproduction system the result is an aberration, in the form of smearing or smudging, of the reproduced music.

SUMMARY OF THE INVENTION

It is therefore an object of the present invention to provide an audio cable in which the relatively low frequency components of the signal are transferred through the cable in the same time as the relatively high frequency components.

It is a further object of the present invention to provide an audio cable of the above type in which the lengths of the conductors forming the cable are varied.

It is a still further object of the present invention to provide an audio cable of the above type in which the outer conductors are wound around the inner conductors.

It is a still further object of the present invention to provide an audio cable of the above type in which the outer conductors are wound into a plurality of bundles which, in turn, are wound about the inner conductors.

Toward the fulfillment of these and other objects, the audio cable of the present invention comprises one or more inner conductors for transmitting the low frequency components of the signal, and a plurality of outer conductors wound around the inner conductor and providing a path for the relatively high frequency components of said signal, with the relative lengths of the outer conductors being greater than the length of the inner conductor. As a result, time variations in the transferrance of the various frequency components are eliminated.

BRIEF DESCRIPTION OF THE DRAWINGS

The above brief description, as well as further objects, features and advantages of the present invention will be more fully appreciated by reference to the following detailed description of the presently preferred but nonetheless illustrative embodiment in accordance with the present invention when taken in conjunction with the accompanying drawings in which.

DESCRIPTION OF THE PREFERRED EMBODIMENT

Figure 1:
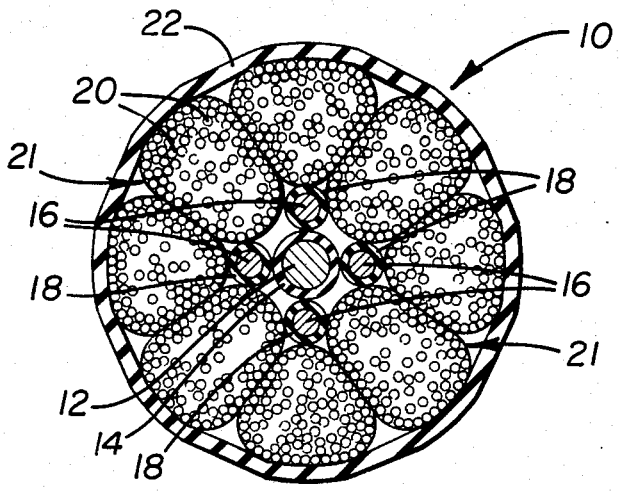
FIG. 1 is a cross-sectional view of an audio cable constructed in accordance with the present invention.

As shown in FIG. 1 the reference numeral 10 refers in general to the audio cable of the present invention, which includes a 22 gage (American Wire Gage-AWG) solid conductor 12 at the center of the cable surrounded by insulation 14. Four 28 gage (AWG) solid conductors 16 are spaced at equalangular positions (i.e. at 90 degree intervals) around the center conductor 12. Each conductor 16 is also surrounded by insulation 18 and is wound in a helical pattern approximately 2 or 3 times per inch around the center conductor 12.

Figure 2:
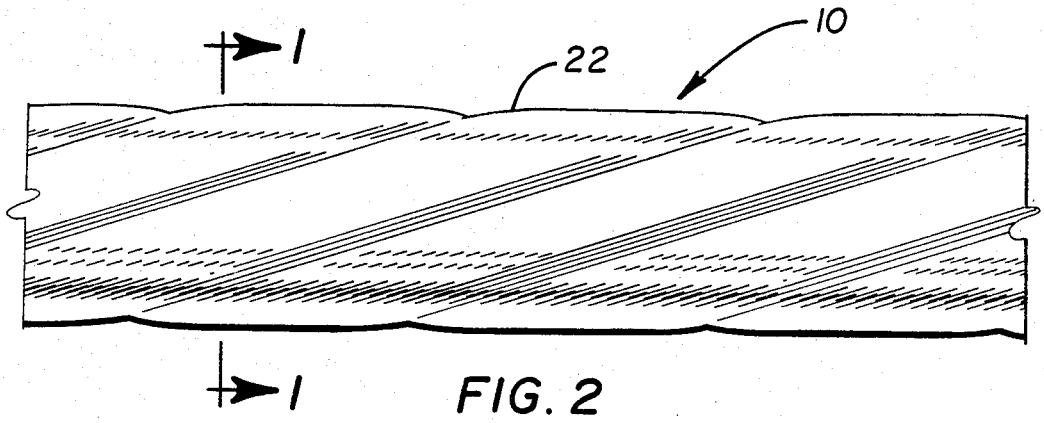
FIG. 2 is a front elevational view of the cable of FIG. 1.

The insulated conductors 12 and 16 are surrounded by a plurality of very fine 46 gage (AWG) uninsulated conductors 20. According to a preferred arrangement, the conductors 20 are formed into eight bundles 21 with each bundle consisting of approximately forty eight conductors. The conductors 20 of each bundle are wound approximately twelve turns per inch and the bundles themselves, in turn, are wound approximately five or six times per inch around the conductors 12 and 16 as better shown in FIG. 2. This winding of the conductors 16 and 20 increases the magnetic field around the conductors thus slowing down the current flow through the conductors, with the degree of winding being selected in a manner to be described.

The outer periphery of the cable 10 defined by the conductors 20 are covered with an outer insulating layer 22.

The length of each conductor 16 is greater than the length of the conductor 12 and the length of each conductor 20 is greater than the length of each conductor 16. The exact lengths of the conductors 12, 16 and 20 are determined in connection with the degree of winding of the conductors 16 and 20 as will be described.

When an audio signal is applied to the cable 10, the high frequency components, from above approximately 700 hertz, are concentrated in the longer outer conductors 20 while the low frequency components, from approximately 0 to 300 hertz tend to flow in the shorter center conductor 12, and the intermediate frequency components from approximately 300 to 700 hertz tend to flow through the intermediate length conductors 16 for the reasons described above. Thus, the longer conductors associated with the higher frequency components compensates for the tendency of the latter components to travel at a greater rate of speed. Also, the winding of the outer conductors in the manner described above increases the magnetic field around the conductors and reduces the speed of the higher frequency components.

As a result, the lengths of the conductors 12, 16 and 20 and the winding of the conductors 16 and 20 can be designed to insure that the various frequency components of the transferred signal arrive at the end of the cable at precisely the same time.

The cable of the present invention has specific utility in connecting various components, such as amplifiers, preamplifiers, etc. together in a high fidelity system or anywhere in the chain where an audio signal is being transmitted. While the cable is ideally suited for high fidelity systems in the foregoing manner, it is understood that it also has valuable utility in any system in which the signal being transmitted contains frequency components extending throughout the audio range.

It is also understood that in a normal application, two cables 10 of the present invention will be provided in a single insulation cover to provide a flow path and a return path for the audio signal, i.e. a positive and a negative flow, and that the cable would be terminated by appropriate connectors, plugs or jacks providing quick detachable connections between the various components. In the latter context, a preferred design criteria would be to select the length and the winding of the outer conductors 16 and 20 so that their respective ends extend flush with the ends of the conductor 12 at both ends of the cable to facilitate connection with the appropriate connectors, plugs or jacks.

Figure 3:
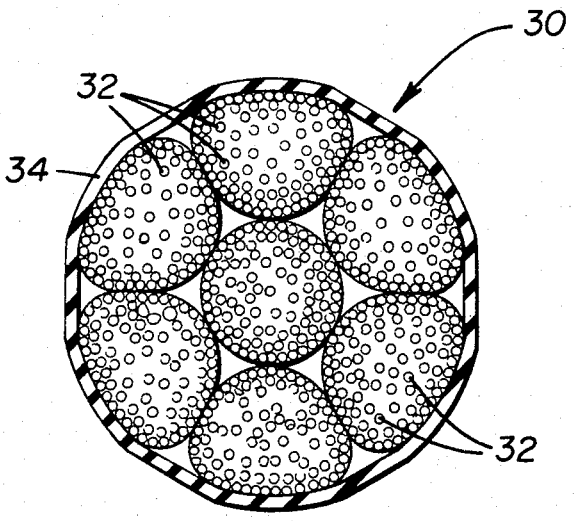
FIG. 3 is a view similar to FIG. 1, but depicting an alternative embodiment of the present invention.

A cable according to an alternate embodiment of the present invention is shown in general by the reference numeral 30 in FIG. 3. The cable 30 consists of a plurality of conductors 32 of the same gage surrounded by insulation 34. The outer conductors 32 have a longer length and are wound more tightly than the inner conductors 32 for the reasons set forth in detail in connection with the previous embodiments. For example, an inner bundle of conductors 32 can be surrounded by several bundles of outer conductors with the conductors in each bundle being slightly wound and the outer bundles being wound around the inner bundle.

More particularly, the conductors 32 can be approximately 36 gage (AWG) and each bundle can contain approximately 48 conductors. The conductors 32 in each bundle can be wound 2 times per inch and six outer bundles surround, and are wound around 3 or 4 times per inch, a single inner bundle.

The length of the conductors 30 forming the outer bundles would be greater than the lengths of the conductors forming the inner bundles to increase the magnetic field around the outer conductors and enable the ends of the respective conductors to extend flush as discussed above.

It is understood that several variations may be made in the foregoing without departing from the scope of the invention. For example, in the embodiment of FIGS. 1 and 2, instead of using a single center conductor, two or more large conductors could be provided at the center and/or a different number of intermediate range conductors 16 can be provided. Further, one or more large conductors 12 can be provided at the center of the cable surrounded by the fine conductors 20 with no intermediate size conductors 16. Still further, it is not necessary that the conductors 12 and 16 be insulated as described in the above preferred embodiment.

Other variations in the foregoing can be made without departing from the scope of the invention which is defined in the appended claims.

What is claimed is:

1. A cable for transmitting signals which have relatively high and relatively low frequency components over substantially the entire audio frequency range comprising at least one inner conductor for principally transmitting the low frequency components of said signal, a plurality of outer conductors surrounding said inner conductor for principally transmitting the relatively high frequency components of said signal, the lengths of the outer conductors being sufficiently greater than the length of the inner conductor to insure substantially equal speeds of transmitting for said low frequency components and said high frequency components along said cable, and an outer layer of insulating material surrounding said outer conductors.

2. The cable of claim 1 wherein the outer conductors are wound around said inner conductor.

3. The cable of claim 1 wherein said outer conductors are formed into a plurality of bundles, each bundle containing a plurality of outer conductors.

4. The cable of claim 3 wherein there are a plurality of inner conductors formed into a single bundle surrounded by said bundles of outer conductors.

5. The cable of claim 1 wherein said inner conductor has a larger diameter than each of said outer conductors.

6. The cable of claim 5 where said inner conductor is a single large-diameter conductor surrounded by a plurality of bundles of said outer conductors, each of which is of a smaller diameter than is said inner conductor.

7. The cable of claim 6 where there are eight bundles of small-diameter outer conductors, each bundle being formed by at least forty conductors.

8. The cable of claim 6 wherein the small-diameter outer conductors of each bundle are twisted approximately twelve turns per inch and said bundles are twisted five or six times per inch about said large-diameter inner conductor.

9. The cable of claim 5 wherein said small-diameter outer conductors are uninsulated and further comprising insulation means covering said large diameter inner conductor.

10. The cable of claim 5 further comprising a plurality of additional conductors each having a diameter greater than the diameter of each small-diameter conductor and less than the diameter of said large-diameter conductor, said additional conductors extending around said large diameter conductor and being surrounded by said small-diameter conductors.

11. The cable of claim 10 wherein the lengths of said additional conductors are greater than the length of said large-diameter conductor and less than the lengths of said small-diameter conductors.

12. The cable of claim 10 wherein said additional conductors are insulated.

13. The cable of claim 10 wherein said large-diameter conductor is positioned at the center of said cable and said small-diameter conductors and said additional conductors are spaced about said large-diameter conductor and are radially spaced from said large-diameter conductor.

14. The cable of claim 5 wherein said large-diameter conductor is 22 gage and said small-diameter conductors are 46 gage.

* * * * *